US007022000B2

(12) United States Patent
Mizomoto et al.

(10) Patent No.: US 7,022,000 B2
(45) Date of Patent: Apr. 4, 2006

(54) WAFER PROCESSING MACHINE

(75) Inventors: Yasutaka Mizomoto, Tokyo (JP); Ichiro Yamahata, Tokyo (JP); Toshimitsu Goto, Tokyo (JP); Masanori Izumita, Tokyo (JP); Katsunori Iizuka, Tokyo (JP); Shinji Yasuda, Tokyo (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 10/993,358

(22) Filed: Nov. 22, 2004

(65) Prior Publication Data

US 2005/0118938 A1 Jun. 2, 2005

(30) Foreign Application Priority Data

Nov. 27, 2003 (JP) ..... 2003-396961

(51) Int. Cl.
*B24B 7/00* (2006.01)

(52) U.S. Cl. ..... 451/65; 451/288; 451/57

(58) Field of Classification Search ..... 451/11, 451/57, 65, 56, 285–289, 389, 66
See application file for complete search history.

(56) References Cited

U.S. PATENT DOCUMENTS 6,159,071 A * 12/2000 Koma et al. ..... 451/5
6,379,230 B1 * 4/2002 Hayashi et al. ..... 451/292
6,431,964 B1 * 8/2002 Ishikawa et al. ..... 451/65
6,500,051 B1 * 12/2002 Nishi et al. ..... 451/41
6,527,627 B1 * 3/2003 Arai ..... 451/41
6,582,287 B1 * 6/2003 Sasayama ..... 451/285
6,780,091 B1 * 8/2004 Mizomoto et al. ..... 451/67
6,846,224 B1 * 1/2005 Ki ..... 451/9

FOREIGN PATENT DOCUMENTS

JP 2000-254857 9/2000

* cited by examiner

*Primary Examiner*—Dung Van Nguyen
(74) *Attorney, Agent, or Firm*—Smith, Gambrell & Russell, LLP

(57) ABSTRACT

A wafer processing machine comprising a turntable, a plurality of chuck tables mounted on the turntable, a grinding means for grinding a wafer held on the chuck table, and a multipurpose polishing means for polishing the ground surface of a wafer held on a chuck table, wherein the multipurpose polishing means comprises a mounter for detachably mounting a polishing tool, a spindle unit for rotating the mounter, a spindle unit support means for supporting the spindle unit in such a manner that the spindle unit can move in a direction perpendicular to the holding surfaces of the chuck tables and in a direction parallel to the holding surfaces of the chuck tables, a first polishing-feed means for moving the spindle unit in a direction perpendicular to the holding surfaces of the chuck tables, and a second polishing-feed means for moving the spindle unit in a direction parallel to the holding surfaces of the chuck tables.

2 Claims, 8 Drawing Sheets

WAFER PROCESSING MACHINE

FIELD OF THE INVENTION

The present invention relates to a wafer processing machine for processing the surface of a wafer such as a semiconductor wafer or an optical device wafer.

DESCRIPTION OF THE PRIOR ART

In the production process of a semiconductor device, a large number of rectangular areas are sectioned by cutting lines called "streets" arranged in a lattice pattern on the front surface of a substantially disk-like semiconductor wafer, and a semiconductor circuit is formed in each of the rectangular areas. Individual semiconductor chips are manufactured by dividing this semiconductor wafer having a large number of semiconductor circuits along the streets. An optical device wafer comprising optical devices composed of gallium nitride-based compound semiconductors laminated in a plurality of areas that are sectioned by streets formed in a lattice pattern on the front surface of a sapphire substrate is also divided into optical devices such as light emitting diodes or laser diodes along dividing lines. The light emitting diodes and laser diodes are widely used in electric equipment.

In general, in order to reduce the size and weight of the obtained chip, before the wafer is cut along the streets to be divided into individual chips, the back surface of the wafer is ground to a predetermined thickness. Grinding of the back surface of the wafer is generally carried out by pressing a grinding tool manufactured by fixing diamond abrasive grains with a suitable bond such as a resin bond, against the back surface of the wafer while it is rotated at a high speed. When the back surface of the wafer is ground with such grinding tool, processing distortion such as a micro-crack or the like is produced on the back surface of the wafer, whereby the breaking strength of the individually divided chip is considerably reduced. As means of removing the processing distortion produced on the ground back surface of the wafer, a wet etching technique for chemically etching the ground back surface of the wafer with an etchant containing nitric acid and hydrofluoric acid or a dry etching technique for etching the ground back surface with an etching gas is used. A polishing technique for polishing the ground back surface of the wafer with free abrasive grains is also actually used. However, there is a problem that when the wafer ground by a grinding machine is carried to an etching machine or polishing machine from the grinding machine to subject it to etching or polishing, the wafer may be broken.

To solve the above problem, JP-A 2000-254857 discloses a processing machine comprising (1) a flattening device having a holding means for holding a workpiece and a grinding means for grinding one surface of the workpiece held by the holding means and (2) a polishing means for polishing the ground surface of the workpiece that is held by the holding means and has been ground by the grinding means.

Polishing by the polishing means as disclosed by the above publication is specified and hence, an appropriate polishing cannot be selected depending on the material, type and the like of the workpiece.

SUMMARY OF THE INVENTION

It is an object of the present invention to provide a wafer processing machine comprising a polishing means in which a surface to be processed of a wafer is ground by a grinding means and an appropriate polishing can be performed on the surface to be processed of the ground wafer in consideration of the material and type of the wafer.

According to the present invention, the above object can be attained by a wafer processing machine comprising a turntable which is turnably arranged, a plurality of chuck tables that are mounted on the turntable and have a holding surface for holding a wafer, a grinding means for grinding a wafer held on the chuck table, and a multipurpose polishing means that is held on the chuck table and polishes the ground surface of a wafer ground by the grinding means, wherein the multipurpose polishing means comprises a mounter for detachably mounting a polishing tool, a spindle unit for rotating the mounter, a spindle unit support means for supporting the spindle unit in such a manner that the spindle unit can move in a direction perpendicular to the holding surfaces of the chuck tables and in a direction parallel to the holding surfaces of the chuck tables, a first polishing-feed means for moving the spindle unit in a direction perpendicular to the holding surfaces of the chuck tables, and a second polishing-feed means for moving the spindle unit in a direction parallel to the holding surfaces of the chuck tables.

The above spindle unit support means comprises a support base having first guide rails extending in a direction parallel to the holding surfaces of the chuck tables, a first movable base having second guide rails that are mounted on the support base in such a manner that it can move along the first guide rails and extend in a direction perpendicular to the holding surfaces of the chuck tables, and a second movable base that is mounted on the first movable base in such a manner that it can move along the second guide rails and mounts the spindle unit. The above first polishing-feed means moves the second movable base along the second guide rails of the first movable base, and the above second polishing-feed means moves the first movable base along the first guide rails of the support base.

The above turntable is constituted such that it turns along the take-in/take-out area for taking in and out a wafer, grinding areas and polishing area so as to position the chuck tables in each of these areas sequentially. The above grinding means are provided in the grinding areas and the above multipurpose polishing means is provided in the polishing area. A plurality of grinding means are provided in the grinding areas and a plurality of multipurpose polishing means are provided in the polishing area. The number of the chuck tables mounted on the turntable is a number obtained by adding the number of grinding means in the grinding areas, the number of multipurpose polishing means in the polishing area and the number of the take-in/take-out areas, the chuck tables are respectively arranged at an equal angle, and when the number of the chuck tables is represented by N, the turntable turns in a range of $(360° \times (N-1)/N)$ in a predetermined direction from the start position and then, turns in a direction opposite to the predetermined direction to return to the start position.

Preferably, a water case for receiving processing water supplied to a wafer, held on the chuck table is arranged around the turntable, an annular sealing portion projects from the under surface of the outer peripheral portion of the turntable, and an annular sealing groove into which the lower end of the sealing portion is fitted is formed in the water case. The above water case is partitioned into the grinding areas and common areas consisting of the polishing area and the take-in/take-out area.

Preferably, the wafer processing machine has a grinding chamber cover means that is arranged in the grinding areas and forms a grinding chamber and a polishing chamber cover means that is arranged in the polishing area and forms a polishing chamber, and diaphragms that are mounted on the top surface of the turntable and partition the chuck tables positioned in the grinding chamber and the polishing chamber. Preferably, the polishing chamber cover means for forming a polishing chamber and the spindle unit of the multipurpose polishing means are interconnected by a boot having flexibility.

Preferably, the wafer processing machine has an air brush means for removing grinding chips adhered to the ground surface of a wafer held on a chuck table when the chuck table is moved from the grinding areas to the polishing area by the turning of the turntable. Preferably, the air brush means is mounted on the grinding chamber cover means for forming the grinding chamber. Preferably, the air brush means has a buffer air tank.

Preferably, the wafer processing machine has a polished surface cleaning means for cleaning the polished surface of a wafer after polishing, held on a chuck table positioned in the take-in/take-out area. Preferably, the wafer processing machine comprises a holding surface cleaning means for cleaning the holding surface of a chuck table positioned in the take-in/take-out area.

The wafer processing machine comprises a first cassette placing portion for placing a first cassette for storing a wafer before processing, a second cassette placing portion for placing a second cassette for storing a wafer after processing, a centering means for doing centering of a wafer before processing, a spinner cleaning means for cleaning and drying a wafer after processing, and a wafer carrying means for carrying a wafer before processing, stored in the first cassette placed on the first cassette placing portion to the centering means and a wafer after processing, cleaned and dried by the spinner cleaning means to the second cassette placed on the second cassette placing portion.

The wafer processing machine further comprises a wafer take-in means for carrying a wafer before processing, of which the centering has been done by the centering means, to a chuck table positioned in the take-in/take-out area and a wafer take-out means for carrying a wafer after processing, held on a chuck table positioned in the take-in/take-out area to the spinner cleaning means.

In the wafer processing machine of the present invention, the multipurpose polishing means for polishing the ground surface of a wafer ground by a grinding means is constituted such that a polishing tool is detachably mounted on the mounter and a spindle unit for turning the mounter can be moved in a direction perpendicular to the holding surfaces of the chuck tables and in a direction parallel to the holding surfaces of the chuck tables. Therefore, appropriate polishing can be made according to the material, type and the like of the wafer.

DETAILED DESCRIPTION OF THE PREFERRED EMBODIMENTS

A wafer processing machine according to a preferred embodiment of the present invention will be described in detail hereinunder with reference to the accompanying drawings.

Figure 1:
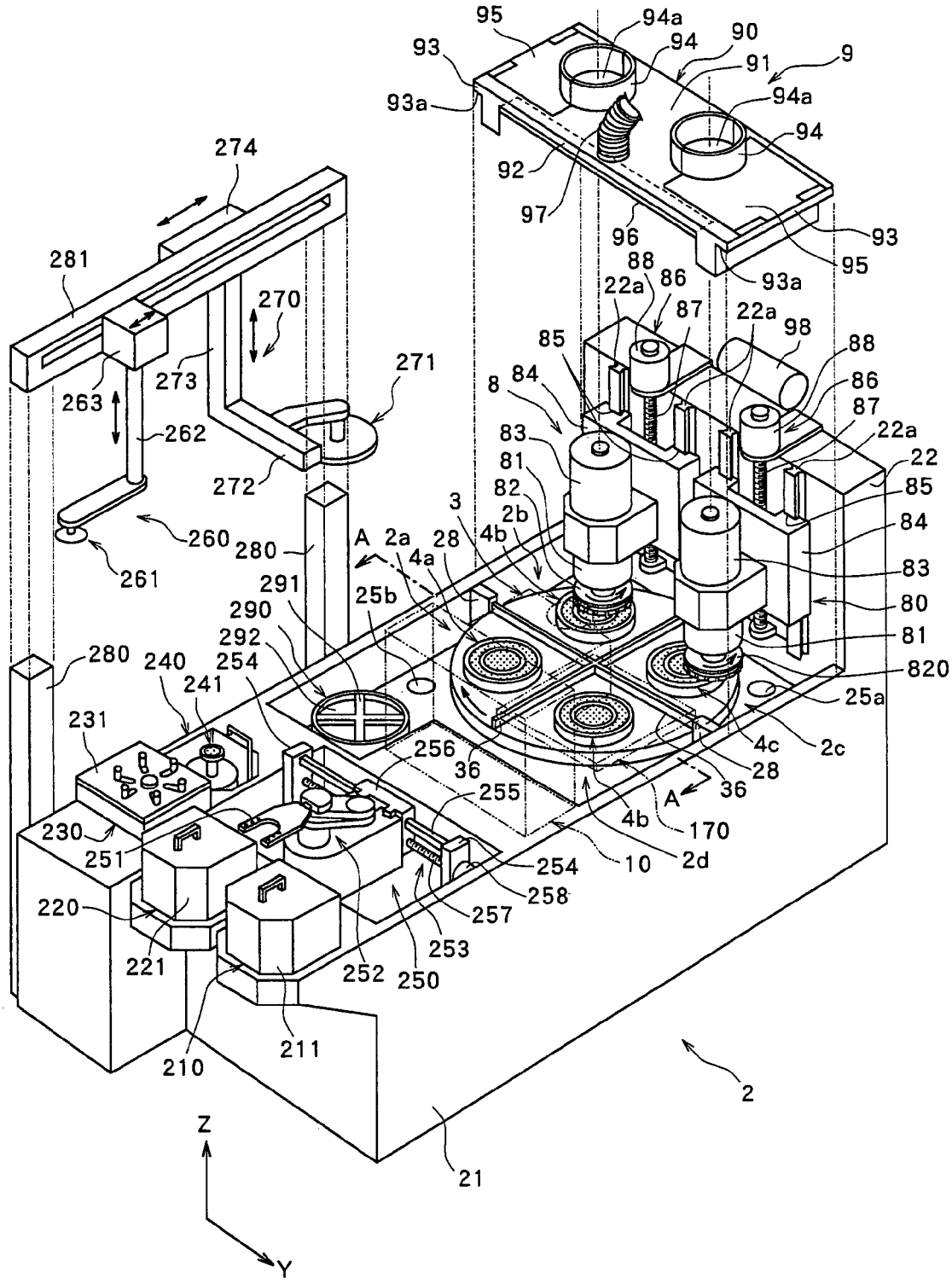
FIG. 1 is a perspective view of a wafer processing machine constituted according to the present invention.

FIG. 1 is a perspective view of a wafer processing machine constituted according to the present invention.

The wafer processing machine shown in FIG. 1 comprises a housing denoted as a whole by numeral 2. The housing 2 contains a rectangular parallelepiped main portion 21 extending long and narrow and an upright wall 22 that is disposed at the back end portion (upper right portion in FIG. 1) of the main potion 21 and extends upward in a substantially vertical direction therefrom. This housing 2 has a workpiece take-in/take-out area 2*a* where a wafer as a workpiece later described is taken in and out, a rough grinding area 2*b*, a finish grinding area 2*c* and a polishing area 2*d*.

A turntable 3 is turnably mounted on the main portion 21 of the above housing 2 and turned along the above take-in/take-out area 2*a*, rough grinding area 2*b*, finish grinding area 2*c* and polishing area 3*d*. This turntable 3 has four chuck tables 4*a*, 4*b*, 4*c* and 4*d*. These four chuck tables 4*a*, 4*b*, 4*c* and 4*d* are arranged at an equal phase angle of 90° in the illustrated embodiment.

Figure 2:
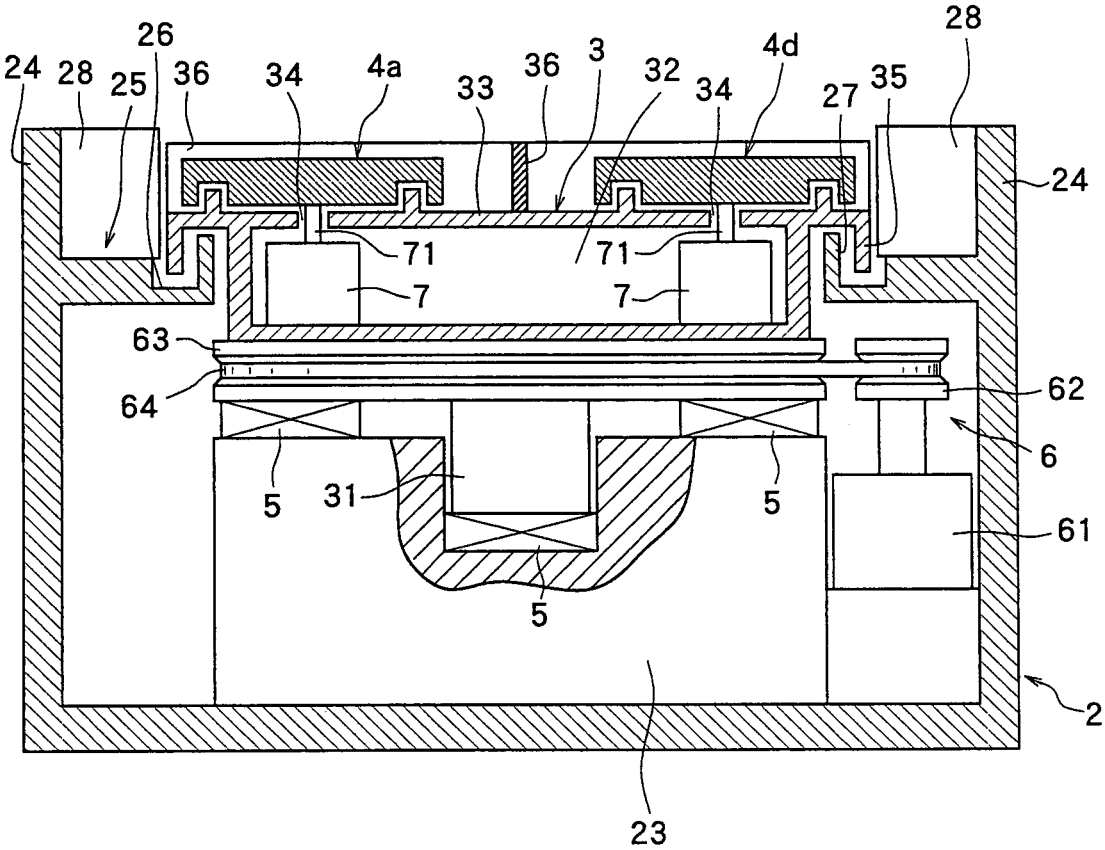
FIG. 2 is a sectional view cut on A—A of FIG. 1.

A description is subsequently given of the above turntable 3 and chuck tables 4*a*, 4*b*, 4*c* and 4*d* with reference to FIG. 2. The turntable 3 has a rotary shaft 31 projecting from its under surface, and this rotary shaft 31 and the under surface of the turntable 3 are rotatably supported to a support member 23 situated in the housing 2 via a plurality of bearings 5. The turntable 3 rotatably supported to the support member 23 is properly turned by a table turning means 6. The table turning means 6 is composed of a pulse motor 61, a drive pulley 62 fitted onto the drive shaft of the pulse motor 61, a driven pulley 63 arranged below the above turntable 3 and an endless belt 64 wound round the drive pulley 62 and the driven pulley 63. The turntable 3 in the illustrated embodiment has a chamber 32 for housing four servo motors 7 (only two chuck tables 4*a* and 4*d* are shown in FIG. 2) for driving the chuck tables 4*a*, 4*b*, 4*c* and 4*d*. Through holes 34 for inserting the drive shafts 71 of the serve motors 7 are formed in the upper wall 33 for defining the chamber 32. The drive shafts 71 of the servo motors 7 are projected upward through the respective through holes 34 and coupled to the respective rotary shafts of the chuck tables 4*a*, 4*b*, 4*c* and 4*d*. An annular sealing portion 35 projects downward from the under surface of the outer peripheral portion of the upper wall 33 for defining the chamber 32 of the turntable 3.

Meanwhile, a water case 25 for containing grinding water and wash water, which will be described later, is formed between the side walls 24 and 24 of the housing 2, that is, around the turntable 3. An annular groove 26 to which the lower end of the annular sealing portion 35 formed at the outer periphery of the turntable 3 is fitted is formed in the water case 25, and an annular sealing portion 27 projects upward from the inner peripheral end of the annular groove 26. The upper end of the annular sealing portion 27 is set at a position higher than the bottom of the water case 25. The thus formed annular groove 26, annular sealing portion 35 and annular sealing portion 27 constitute a sealing mechanism for preventing grinding water and wash water dropped on the water case 25 from flowing into the inside from the annular groove 26 and the sealing portion 27. The water case 25 is partitioned into grinding areas consisting of the rough grinding area 2*b* and the finish grinding area 2*c* and common areas consisting of the polishing area 2*d* and the take-in/take-out area 2*a* by partition walls 28 and 28 projecting inward from the side walls 24 and 24 of the housing 2, respectively, as shown in FIG. 1. An exhaust port 25*a* and an exhaust port 25*b* are formed on the grinding area side consisting of the rough grinding area 2*b* and the finish grinding area 2*c* and the common area side consisting of the polishing area 2*d* and the take-in/take-out area 2*a* of the water case 25, respectively, so that different types of drainages can be disposed separately.

The above chuck tables 4*a*, 4*b*, 4*c* and 4*d* are made of a suitable porous material such as porous ceramics and are so constituted as to allow properly to hold a wafer having a large diameter and a wafer having a small diameter by a large-diameter rib and a small-diameter rib, and are connected with a suction means that is not shown. Therefore, the chuck tables 4*a*, 4*b*, 4*c* and 4*d* are selectively connected to the suction means by a suction hose (not shown) so as to suction-hold the later-described wafer as the workpiece which is placed on the top surface, that is, the holding surface.

Returning to FIG. 1, diaphragms 36 for partitioning the areas where the above four chuck tables 4*a*, 4*b*, 4*c* and 4*d* are arranged are installed on the top surface of the above turntable 3. The diaphragms 36 and 36 are higher than the chuck tables 4*a*, 4*b*, 4*c* and 4*d*. The diaphragms 36 and 36 serve to partition the chuck tables positioned respectively in a grinding chamber formed by a grinding chamber cover means, which is provided in the grinding areas consisting of the above rough grinding area 2*b* and the finish grinding area 2*c* and will be described later and in a polishing chamber formed by a polishing chamber cover means, which is provided in the above polishing area 2*d* and will be described later.

A rough grinding unit 8 as a rough grinding means is provided in the above rough grinding area 2*b*. The rough grinding unit 8 comprises a unit housing 81, a rough grinding wheel 82 rotatably mounted on the lower end of the unit housing 81, a servo motor 83 that is mounted on the upper end of the unit housing 81 and rotates the grinding wheel 82 in the direction indicated by the arrow, and a movable base 84 onto which the unit housing 81 is mounted. The movable base 84 is provided with a pair of to-be-guided grooves 85 and 85, and the rough grinding unit 8 is supported movably in a vertical direction, that is, in a direction perpendicular to the holding surfaces of the chuck tables 4*a*, 4*b*, 4*c* and 4*d* by movably fitting the to-be-guided grooves 85 and 85 to guide rails 22*a* and 22*a* provided on the above upright wall 22, respectively. The rough grinding unit 8 in the illustrated embodiment has a grinding-feed means 86 for moving the above movable base 84 along the guide rails 22*a* and 22*a* to adjust the cutting depth of the grinding wheel 82. The grinding-feed means 86 comprises a male screw rod 87 that is arranged parallel to the guide rails 22*a* and 22*a* provided on the above upright wall 22 in a vertical direction and is rotatably supported, a pulse motor 88 for rotary-driving the male screw rod 87 and a female screw block (not shown) which is mounted on the above movable base 84 and is screwed with the male screw rod 87. By turning the male screw rod 87 in a normal direction or reverse direction with the pulse motor 88, the rough grinding unit 8 is moved in the vertical direction.

In the above finish grinding area 2*c*, there is installed a finish grinding unit 80 as a finish grinding means. The finish grinding unit 80 is substantially the same as the rough grinding unit 8 in constitution except that a finish grinding wheel 820 differs from the rough grinding wheel 82 of the above rough grinding unit 8. Therefore, the same members as the constituent members of the rough grinding unit 8 are given the same reference symbols and their descriptions are omitted.

The processing machine in the illustrated embodiment comprises a grinding chamber cover means 9 that is installed in the above rough grinding area 2*b* and the finish grinding area 2*c* and forms a grinding chamber. This cover means 9 as a whole comprises a box-like cover member 90 having an upper wall 91, a front wall 92 and both side walls 93 and 93. The both side walls 93 and 93 of the cover member 90 have shoulder faces 93*a* and 93*a* facing downward at intermediate positions in the vertical direction, the lower half portions of the both side walls 93 and 93 are brought in close contact with the side faces of the side walls 24 and 24 of the housing 2, and the shoulder faces 93*a* and 93*a* are placed on the top surfaces of the side walls 24 and 24 of the housing 2. Circular openings 94*a* and 94*a* for permitting insertion of the rough grinding wheel 82 and the finish grinding wheel 820 are formed in the upper wall 91 of the cover member 90, and there are formed cylindrical members 94 and 94 extending upward from the peripheries of the circular openings 94*a* and 94*a*, respectively. A cylindrical bellows member made of extensible rubber is interrposed between the cylindrical members 94 and 94 and the unit housings 81 and 81, and the both ends of the bellows members are preferably mounted onto the cylindrical members 94 and 94 and the unit housings 81 and 81, respectively. Substantially half portions of the cylindrical members 94 and 94 and part of the upper wall 91 are formed separately from the upper wall 91 and constitute doors 95 and 95 for maintenance, which can be opened and closed about the outer side edges as the centers thereof. An air brush nozzle 96 constituting an air brush means is furnished the front wall 92 of the cover member 90. The air brush nozzle 96 is connected to a buffer air tank 98 as a compressed air supply means mounted to the upright wall 22 of the housing 2 by an air duct 97. The thus constituted air brush means blows compressed air stored in the buffer air tank 98 against the ground wafer from the air brush nozzle 96 at a rate of about 20 liter/sec when the wafer as the workpiece held on the chuck table 4*a*, 4*b*, 4*c* or 4*d* of the above turntable 3 is moved to the polishing area 2*b* after it is roughly ground in the rough grinding area 2*b* and finish-ground in the finish grinding area 2*c*. As a result, polishing chips and grinding-processing water adhered to the wafer during grinding are removed by a blow of the compressed air.

Figure 3:
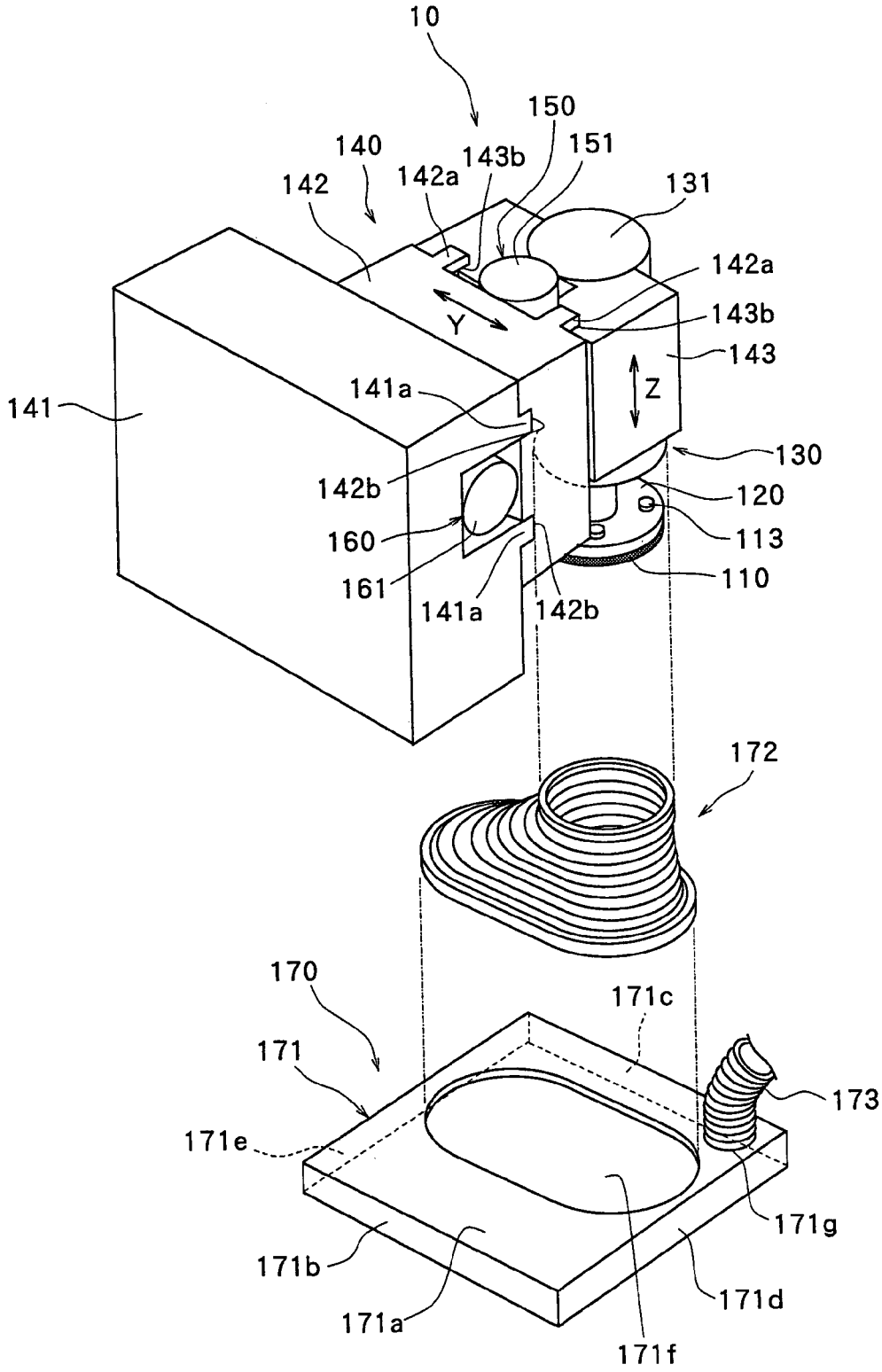
FIG. 3 is a perspective view of multipurpose polishing means provided in the wafer processing machine shown in FIG. 1.

A multipurpose polishing means 10 is arranged in the above polishing area 2*d* (contours of part of the means is shown by a two-dot chain line in FIG. 1). This multipurpose polishing means 10 will be described with reference to FIG. 3. The multipurpose polishing means 10 shown in FIG. 3 has a mounter 120 for detachably mounting a polishing tool 110, a spindle unit 130 for rotating the mounter 120, a spindle unit support means 140 for supporting the spindle unit 130 such that it can be moved in a direction (Z direction) perpendicular to the holding surfaces of the chuck tables 4*a*, 4*b*, 4*c* and 4*d* and a direction (Y direction) parallel to the holding surfaces of the chuck tables, a first polishing-feed means 150 for moving the spindle unit 130 in the direction (Z direction) perpendicular to the holding surfaces of the chuck tables, and a second polishing-feed means 160 for moving the spindle unit 130 in the direction (Y direction) parallel to the holding surfaces of the chuck tables. The spindle unit 130 has a servo motor 131 for rotary-driving the above mounter 120.

The spindle unit support means 140 comprises a support base 141, a first movable base 142 and a second movable base 143 in the illustrated embodiment. First guide rails 141a and 141*a* extending in the direction indicated by the arrow Y parallel to the holding surfaces of the above chuck tables 4*a*, 4*b*, 4*c* and 4*d* are provided on one flank of the support base 141. First to-be-guided grooves 142*b* and 142*b* to be fitted to the first guide rails 141a and 141a on the above support base 141 are formed in one flank of the above first movable base 142, and second guide rails 142*a* and 142*a* extending in the direction indicated by the arrow Z perpendicular to the holding surfaces of the above chuck tables 4*a*, 4*b*, 4*c* and 4*d* are provided on the other flank of the first movable base 142. The thus constituted first movable base 142 can be movably supported along the first guide rails 141*a* and 141*a* on the above support base 141 by fitting the first to-be-guided grooves 142*b* and 142*b* to the first guide rails 141*a* and 141*a* on the support base 141, respectively.

Second to-be-guided grooves 143*b* and 143*b* to be fitted to the second guide rails 142*a* and 142*a* on the first movable base 142 are formed in one flank of the above second movable base 143. The second movable base 143 can be movably supported along the second guide rails 142*a* and 12*a* of the first movable base 142 by fitting the second to-be-guided grooves 143*b* and 143*b* to the second guide rails 142*a* and 142*a* on the first movable base 142, respectively. The above spindle unit 130 is mounted to the other flank side of the second movable base 143.

The above first polishing-feed means 150 is the same as the above grinding-feed means 86 in constitution. That is, the first polishing-feed means 150 comprises a pulse motor 151, a male screw rod (not shown) that is arranged between the second guide rails 142*a* and 142*a* in parallel thereto and is rotary-driven by the pulse motor 151, and a female screw block (not shown) which is mounted onto the second movable base 143 and screwed with the male screw rod. By turning the male screw rod (not shown) in a normal direction or reverse direction with the pulse motor 151, the second movable base 143, that is, the spindle unit 130 is moved in the direction indicated by the arrow Z perpendicular to the holding surfaces of the above chuck tables 4*a*, 4*b*, 4*c* and 4*d*.

The above second polishing-feed means 160 comprises a pulse motor 161, a male screw rod (not shown) arranged between the first guide rails 141*a* and 141*a* in parallel thereto and rotary-driven by the pulse motor 151, and a female screw block (not shown) which is mounted to the first movable base 142 and screwed with the male screw rod. By turning the male screw rod (not shown) in a normal direction or reverse direction with the pulse motor 161, the first movable base 142, that is, the second movable base 143 and the spindle unit 130 are moved in the direction indicated by the arrow Y parallel to the holding surfaces of the above chuck tables 4*a*, 4*b*, 4*c* and 4*d*.

Figure 4:
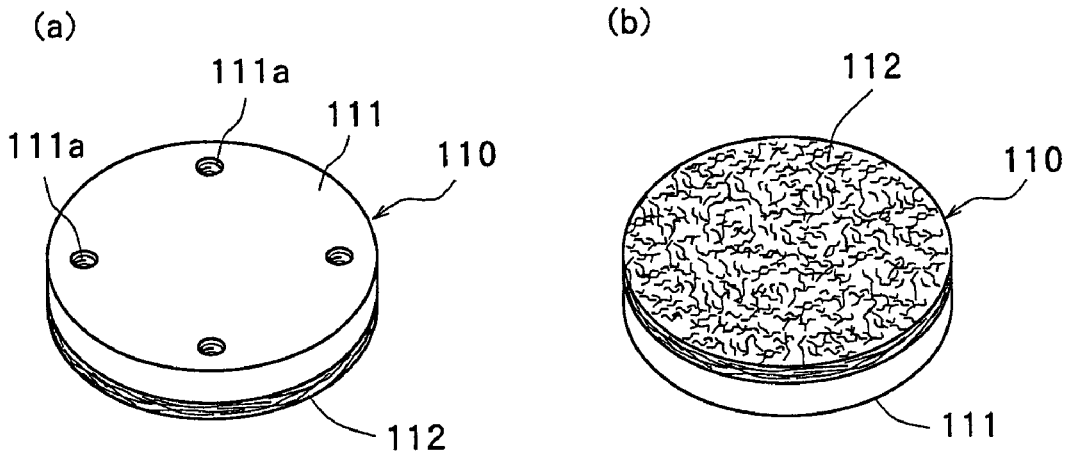
FIGS. 4(*a*) and 4(*b*) are perspective views showing an embodiment of a polishing tool mounted on the multipurpose polishing means shown in FIG. 3.
Figure 5:
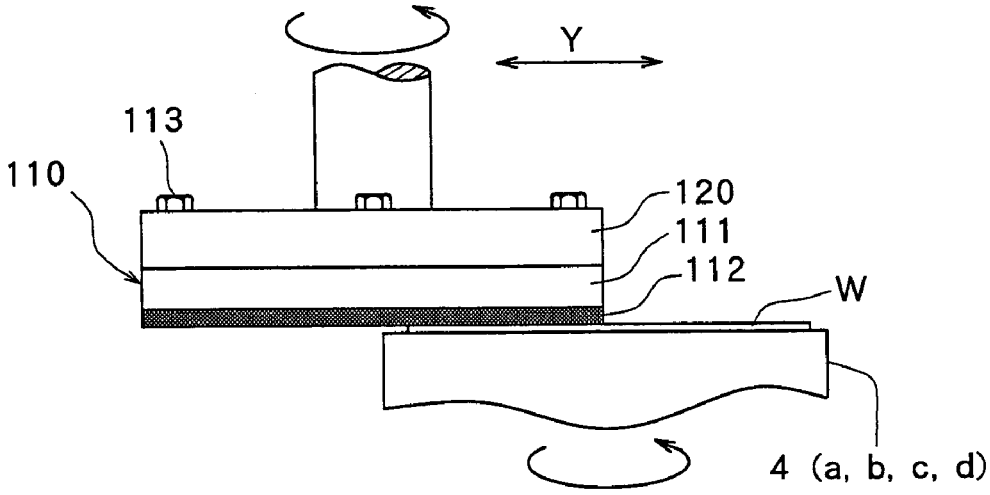
FIG. 5 is a diagram showing a polishing method for polishing a wafer with the polishing tool shown in FIG. 4.

A description is subsequently given of the above polishing tool 110 with reference to FIGS. 4(*a*) and 4(*b*) and FIG. 5. The polishing tool 110 shown in FIGS. 4(*a*) and 4(*b*) and FIG. 5 is composed of a disk-like support member 111 and a disk-like polishing member 112 mounted on the support member 111. In the support member 111, a plurality of blind screw holes 111*a* extending downward from the top surface thereof are formed at equal intervals in the circumferential direction. The under surface of the support member 111 serves as a circular support surface and the polishing member 112 is bonded to the support surface by a suitable adhesive such as an epoxy resin-based adhesive. As the polishing member 112 is used a felt grindstone manufactured by dispersing abrasive grains in felt and fixing them with a suitable adhesive. The thus constituted polishing tool 110 is positioned on the under surface of the mounter 120 and detachably fixed to the mounter 120 by screwing fastening bolts 113 into the blind screw holes 111*a* formed in the support member 111 of the polishing tool 110 via through holes formed in the mounter 120 as shown in FIG. 5. For polishing with the thus constituted polishing tool 110, as shown in FIG. 5, the mounter 120, that is, the polishing tool 110 is rotated, the chuck table 4 (a, b, c or d) is rotated, and the polishing member 112 is moved from the peripheral portion of the wafer W over the center thereof in the direction indicated by the arrow Y while it is pressed against the wafer W held on the chuck table 4 (a, b, c or d) to perform a dry polish-processing of the wafer W.

Figure 6:
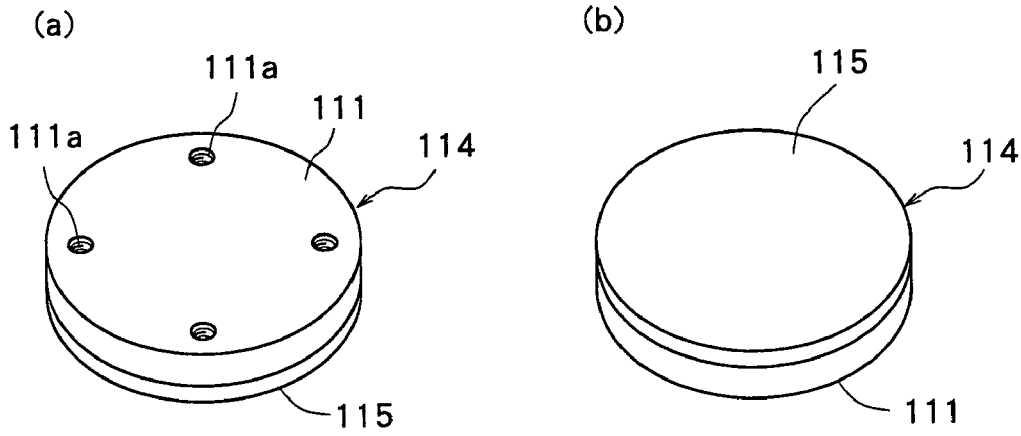
FIGS. 6(*a*) and 6(*b*) are perspective views showing another embodiment of a polishing tool mounted on the multipurpose polishing means shown in FIG. 3.
Figure 7:
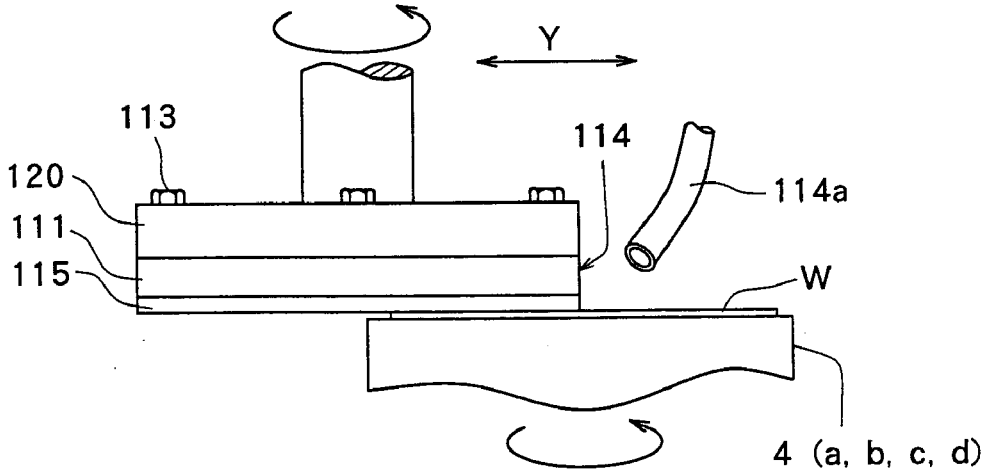
FIG. 7 is a diagram showing a polishing method for polishing a wafer with the polishing tool shown in FIG. 6.

A description is subsequently given of another embodiment of the polishing tool with reference to FIGS. 6(*a*) and 6(*b*) and FIG. 7. The polishing tool 114 shown in FIGS. 6(*a*) and 6(*b*) and FIG. 7 is composed of the above support member 111 and a disk-like polishing pad 115 bonded to the circular support surface of the support member 111 by an adhesive. The polishing pad 115 is made of urethane or the like. The thus constituted polishing tool 114 is detachably mounted to the above mounter 120 in the same manner as described above. For polishing with this polishing tool 114, as shown in FIG. 7, the mounter 120, that is, the polishing tool 114 is rotated and the chuck table 4 (a, b, c or d) is also rotated, and the polishing pad 115 is moved from the peripheral portion of the wafer W over the center thereof in the direction indicated by the arrow Y while it is pressed against the wafer W held on the chuck table 4 to polish the wafer W while free abrasive grains are supplied to the polishing portion from a free abrasive grain supply pipe 114*a*.

Figure 8:
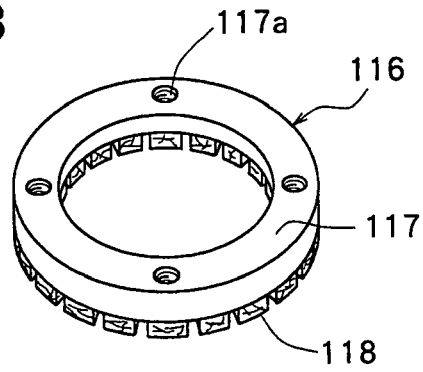
FIG. 8 is a perspective view showing still another embodiment of a polishing tool mounted on the multipurpose grinding means shown in FIG. 3.
Figure 9:
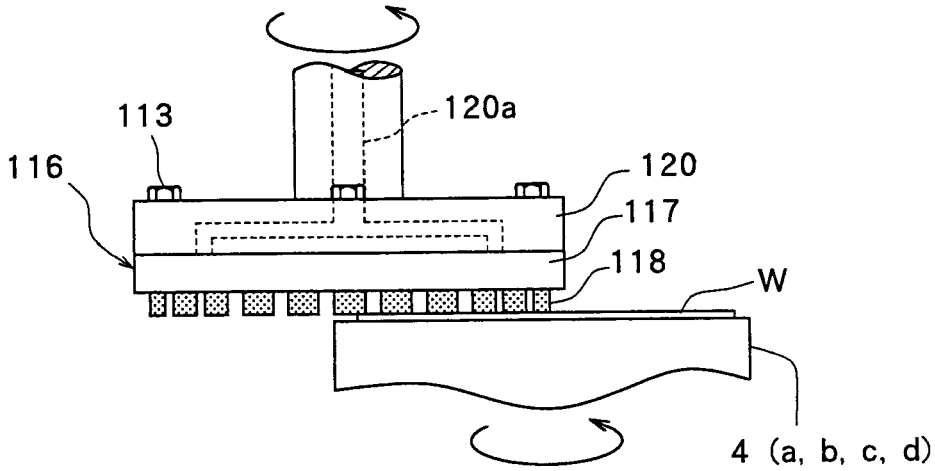
FIG. 9 is a diagram showing an embodiment of a polishing method for polishing a wafer with the polishing tool shown in FIG. 8.
Figure 10:
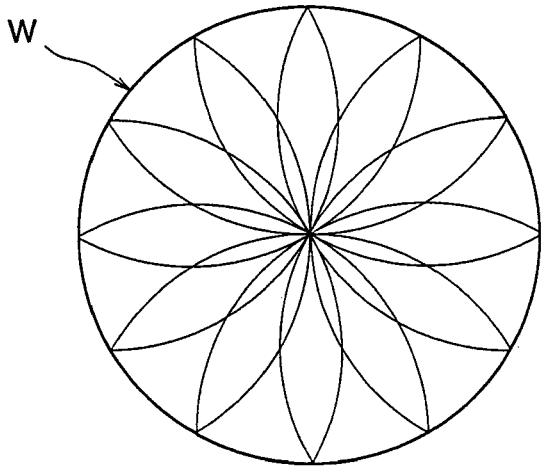
FIG. 10 is a diagram showing the processed surface of the wafer polished by the polishing method shown in FIG. 9.

A description is subsequently given of still another embodiment of the polishing tool with reference to FIGS. 8 and 9. The polishing tool 116 shown in FIGS. 8 and 9 is composed of an annular support member 117 and a polishing grindstone 118 mounted on the under surface of the support member 117. In the annular support member 117, a plurality of blind screw holes 117*a* extending downward from the top surface thereof are formed at equal intervals in the circumferential direction. The polishing grindstone 118 is constituted by a grindstone manufactured by fixing diamond abrasive grains or the like with a resin bond. The polishing grindstone 118 preferably has an abrasive grain diameter of 1 μm or less. The thus constituted polishing tool 116 is detachably mounted to the above mounter 120 in the same manner as described above. A processing liquid passage 120*a* for supplying a polishing liquid is formed in the mounter 120 as shown in FIG. 9. For polishing with the thus constituted polishing tool 116, as shown in FIG. 9, the mounter 120, that is, the polishing tool 116 is rotated and the chuck table 4 (a, b, c or d) is also rotated, and the polishing grindstone 118 is moved from the peripheral portion over the center while it is pressed against the wafer W held on the chuck table 4 (a, b, c or d) to polish the wafer W while the polishing water is supplied from the processing liquid passage 120*a*. A saw mark as shown in FIG. 10 is formed on the polished surface of the wafer W by this processing.

Figure 11:
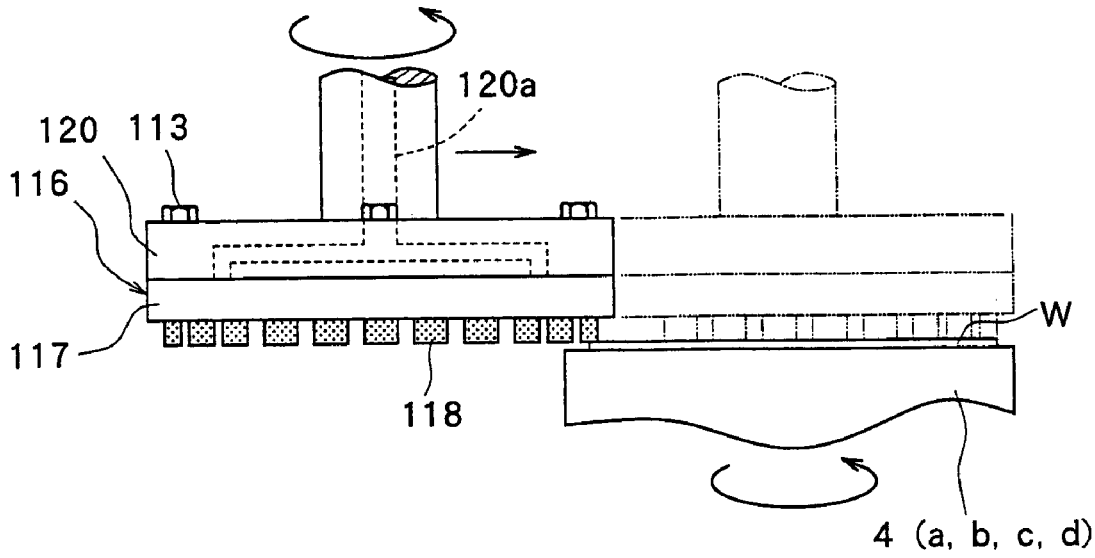
FIG. 11 is a diagram showing another embodiment of a polishing method for polishing the wafer with the polishing tool shown in FIG. 8.
Figure 12:
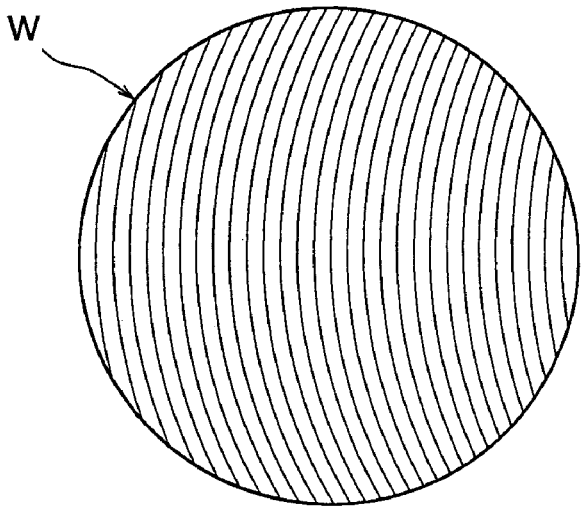
FIG. 12 is a diagram showing the processed surface of the wafer polished by the polishing method shown in FIG. 11.

Another embodiment of the method of polishing with the polishing tool 116 shown in FIG. 8 and FIG. 9 will be described with reference to FIG. 11. As shown in FIG. 11, the mounter 120, that is, the polishing tool 116 is rotated while polishing water is supplied from the processing liquid passage 120*a*, and the grindstone 118 is moved from peripheral one end to the other peripheral end of the wafer W held on the chuck table 4 (a, b, c or d) to polish the wafer W. In this polishing method, the chuck table, that is, the wafer W is not rotated. By this processing, a saw mark as shown in FIG. 12 is formed on the polished surface of the wafer W and can be made in a direction in connection with the crystal orientation of the wafer W so that it is hardly broken.

Returning to FIG. 3, the processing machine in the illustrated embodiment has a polishing chamber cover means 170 for forming a polishing chamber in the polishing area 2*d* (see FIG. 1). This polishing chamber cover means 170 comprises a cover member 171 that is open at the bottom and shaped like a box as a whole, and this cover member 171 has an upper wall 171*a* and side walls 171*b*, 171*c*, 171*d* and 171*e*. An elliptic hole 171*f* is formed in the upper wall 171*a* of the cover member 171. This hole 171*f* is prolonged in the Y direction, and the above polishing tool 110 can be inserted through the hole 171*f*. The cover means 170 in the illustrated embodiment has a boot 172 for interconnecting the cover member 171 and the spindle unit 130. The boot 172 is shaped like bellows and made of a flexible material such as rubber, its lower end is connected to the periphery of the elliptic hole 17*f* of the cover member 171, and its upper end is connected to the spindle unit 130. The thus constituted boot 172 prevents the scattering of polishing powders generated in the polishing chamber and allows for the movement of the spindle unit 130, that is, the polishing tool 110 in the Y direction and Z direction. An exhaust port 171*g* is formed in the upper wall 171*a* of the cover member 171 and connected to a dust collecting means (not shown) through a dust collecting duct 173. The cover member 171 of the thus constituted polishing chamber cover means 170 is installed on the top side of the turntable 3 in the polishing area 2*d*, as partially shown by a two-dot chain line in FIG. 1.

Returning to FIG. 1, a first cassette placing portion 210 and a second cassette placing portion 220 are formed at the front end (lower left end in FIG. 1) of the main portion 21 of the housing 2. A first cassette 211 for storing a wafer before processing is placed on the first cassette placing portion 210 and a second cassette 221 for storing a wafer after processing is placed on the second cassette placing portion 220. A temporary storage area 230 is formed in the front part (lower left in FIG. 1) of the main portion 21 of the housing 2, and a centering means 231 for doing centering of the wafer before processing carried out from the above first cassette 211 is installed in this temporary storage area 230. In the rear (upper right in FIG. 2) of the temporary storage area 230, a cleaning area 240 is provided, and a spinner cleaning means 241 for cleaning the wafer after processing is installed in this cleaning area 240. This spinner cleaning means 241 cleans the wafer processed by the above rough grinding unit 8 as the rough grinding means, finish grinding unit 80 as the finish grinding means and multipurpose polishing means 10, and dries the cleaned surface of the wafer with a spin drier to remove wash water.

A wafer conveying means 250 is installed behind the above first cassette placing portion 210 and the above second cassette placing portion 220. This wafer conveying means 250 comprises a conventionally known multi-axial joint robot 252 having a hand 251 and a moving means 253 for moving the multi-axial joint robot 252 in the width direction of the housing 2. The moving means 253 comprises a guide rod 255 mounted onto support posts 254 and 254 installed on the main portion 21 of the housing 2 at a space therebetween in the direction of width, a movable block 256 movably mounted onto the guide rod 255, a screw rod 257 that is arranged parallel to the guide rod 255 and is screwed into a threaded hole formed in the movable block 256, and a pulse motor 258 capable of rotary-driving the screw rod 257 in a normal direction and reverse direction. The above multi-axial joint robot 252 is mounted on the movable block 256. The thus constituted moving means 253 moves the movable block 256, that is, the multi-axial joint robot 252 along the guide rod 255 by driving the pulse motor 258 in a normal direction or reverse direction to rotate the screw rod 257. By operating the moving means 253 and the multi-axial joint robot 252, the wafer conveying means 250 as constituted above takes out the wafer before processing that is stored at a predetermined position of the above first cassette 211 and carries it to the above centering means 231 and as well, carries the wafer that has been cleaned and dried by the above spinner cleaning means 241 to a predetermined position of the second cassette 221.

The processing machine in the illustrated embodiment comprises a wafer take-in means 260 for carrying the wafer before processing which has been carried to the above centering means 231 and of which the centering has been done, to the chuck table 4 (a, b, c or d) positioned in the above take-in/take-out area 2*a*, and a wafer take-out means 270 for taking out the wafer after processing held on the chuck table 4 (a, b, c or d) positioned in the above take-in/take-out area 2*a* and carrying it to the above spinner cleaning means 241. The wafer take-in means 260 and the wafer take-out means 270 can be moved along a guide rail 281 fixed to support poles 280 and 280 installed on the housing 2 and extending in the longitudinal direction of the housing 2. The wafer take-in means 260 comprises a suction pad 261, a support rod 262 for supporting, at its lower end, the suction pad 261 and a movable block 263 that is connected to the upper end of the support rod 262 and fitted to the guide rail 281. The movable block 263 of the thus constituted wafer take-in means 260 is suitably moved along the guide rail 281 by a moving means that is not shown, and the support rod 262 is suitably moved in the vertical direction by a moving means that is not shown.

The wafer take-out means 270 comprises a suction pad 271, a guide rail 272 for movably supporting the suction pad 271 in the direction indicated by the arrow, a support rod 273 for supporting, at its lower end, the guide rail 272, and a movable block 274 that is connected to the upper end of the support rod 273 and fitted to the above guide rail 281. The diameter of the suction pad 271 of the wafer take-out means 270 is larger than the diameter of the suction pad 261 of the above wafer take-in means 260. The reason why the diameter of the suction pad 271 of the wafer take-out means 270 is made large is that the suction-holding area is made large because a wafer, which has been processed and hence, become thin, is easily broken. Large-diameter and small-diameter ribs are formed on the suction surface of the suction pad 271 so that a large-diameter wafer and a small-diameter wafer can be properly adsorbed like the above-mentioned chuck tables. The movable block 274 of the thus constituted wafer take-out means 270 is suitably moved along the guide rail 281 by a moving means that is not shown, the suction pad 271 is suitably moved along the guide rail 272 in a direction perpendicular to the guide rail 281 as indicated by the arrow by a moving means that is not shown, and the support rod 273 is suitably moved in the vertical direction indicated by the arrow by a moving means that is not shown.

The processing machine in the illustrated embodiment comprises a suction pad cleaning means 290 for cleaning the holding surface (under surface) of the suction pad 271 of the above wafer take-out means 270. This suction pad cleaning means 290 is constituted by a rotary cleaning sponge 291 and a cleaning pool 292 for holding the cleaning sponge 291 in a state of being immersed in water, and is arranged in the travel route of the suction pad 271 between the above take-in/take-out area 2*a* and the spinner cleaning means 241.

The processing machine in the illustrated embodiment has a chuck table cleaning means for cleaning the holding surface of the chuck table 4 (a, b, c or d) positioned in the above take-in/take-out area 2*a* and a processed surface cleaning means for cleaning the processed surface of the wafer after processing held on the chuck table 4 (a, b, c or d) positioned in the take-in/take-out area 2*a*. The chuck table cleaning means and the processed surface cleaning means will be described with reference to FIG. 13.

Figure 13:
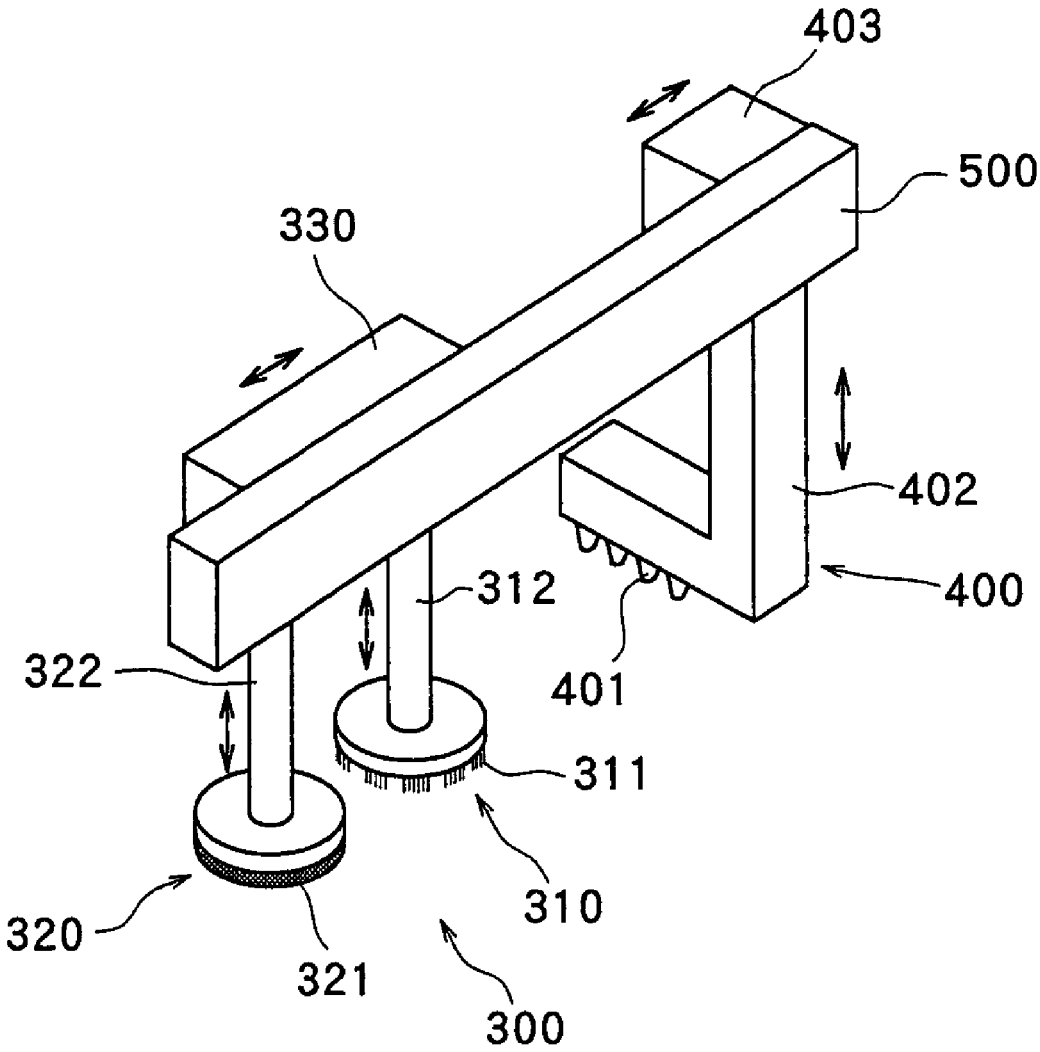
FIG. 13 is a perspective view of a chuck table cleaning means and a processed surface cleaning means provided in the wafer processing machine shown in FIG. 1.

The chuck table cleaning means 300 and the processed surface cleaning means 400 shown in FIG. 13 are mounted on a cover frame (not shown) surrounding the processing machine and fitted in a guide rail 500 extending in the longitudinal direction of the housing 2 in such a manner that it can move in the longitudinal direction. The chuck table cleaning means 300 comprises a brush cleaning means 310 and a grindstone cleaning means 320. The brush cleaning means 310 is composed of a cleaning brush 311, a support rod 312 for supporting, at the lower end, the cleaning brush 311, and a movable block 330 that is connected to the upper end of the support rod 312 and fitted to the above guide rail 500. The movable block 330 of the thus constituted brush cleaning means 310 is suitably moved along the guide rail 500 by a moving means (not shown) as indicated by the arrow and the support rod 312 is suitably moved in the vertical direction by a moving means (not shown) as indicated by the arrow. The cleaning brush 311 is rotated by a rotary-drive means that is not shown. The above grindstone cleaning means 320 is composed of an oil stone 321 and a support rod 322 that supports, at its lower end, the oil stone 321 and connected, at its upper end, to the above movable block 330. The support rod 322 of the thus constituted grindstone cleaning means 320 is suitably moved in the vertical direction indicated by the arrow by a moving means that is not shown. The oil stone 321 is rotated by a rotary-drive means that is not shown.

The above processed surface cleaning means 400 comprises wash water ejection nozzles 401, a support rod 402 for supporting, at its lower end, the wash water ejection nozzles 401, and a movable block 403 that is connected to the upper end of the support rod 402 and fitted to the above guide rail 500. The wash water ejection nozzles 401 are connected to a wash water supply means (not shown) and a high-pressure air supply means (not shown) via hoses that are not shown. Therefore, the processed surface cleaning means 400 ejects wash water with high-pressure air from the wash water ejection nozzles 401 to clean the processed surface of the wafer after processing. The movable block 403 of the thus constituted processed surface cleaning means 400 is suitably moved along the guide rail 500 as indicated by the arrow by a moving means that is not shown, and the support rod 402 is suitably moved in the vertical direction as indicated by the arrow by a moving means that is not shown.

The wafer processing machine in the illustrated embodiment is constituted as described above, and its operation will be described with reference to FIG. 1 mainly.

To process the wafer with the above-described processing machine, the first cassette 211 for storing a wafer before processing is placed on the first cassette placing portion 210 and the empty second cassette 221 for storing a wafer after processing is also placed on the second cassette placing portion 220. When a processing start switch (not shown) is then turned on, the wafer conveying means 250 is activated to take out a wafer before processing, stored at a predetermined position of the first cassette 211 placed on the first cassette placing portion 210 and carry it to the centering means 231. The centering means 231 performs the centering of the conveyed wafer before processing. Thereafter, the wafer take-in means 260 is activated to carry the wafer before processing, of which the centering has been done by the centering means 231, onto the chuck table 4*a* positioned in the above take-in/take-out area 2*a*. At a point of time of start of processing, the turntable 3 is situated at the start position shown in FIG. 1, the chuck table 4*a* of the turntable 3 is positioned in the take-in/take-out area 2*a*, the chuck table 4*b* in the rough grinding area 2*b*, the chuck table 4*c* in the finish grinding area 2*c* and the chuck table 4*d* in the polishing area 2*c*. The wafer before processing placed on the chuck table 4*a* positioned in the take-in/take-out area 2*a* by the wafer take-in means 260 is suction-held on the chuck table 4*a* by a suction means which is not shown.

After the wafer before processing is suction-held on the chuck table 4*a* positioned in the take-in/take-out area 2*a*, the above table turning means 6 (see FIG. 2) is activated to turn the above turntable 3 at an angle of 90° in the illustrated embodiment in a predetermined direction indicated by an arrow in FIG. 1. As a result, the chuck table 4*a* suction-holding the wafer before processing is positioned in the rough grinding area 2*b*, the chuck table 4*b* in the finish grinding area 2*c*, the chuck table 4*c* in the polishing area 2*d* and the chuck table 4*d* in the take-in/take-out area 2*a*, respectively. After the chuck tables 4*a*, 4*b*, 4*c* and 4*d* are positioned in the respective areas, the wafer held on the chuck table 4*a* positioned in the rough grinding area 2*b* is roughly ground with the rough grinding unit 8. During this, a wafer before processing is carried to the chuck table 4*d* positioned in the take-in/take-out area 2*a* and suction-held on the chuck table 4*d*.

Then, the table turning means 6 is activated to turn the above turntable 3 further at 90° in the predetermined direction indicated by the arrow in FIG. 1 (therefore, the turntable turns at 180° from the start position in FIG. 1). As a result, the chuck table 4*a* holding the wafer roughly ground in the rough grinding area 2*b* is positioned in the finish grinding area 2*c*, and the chuck table 4*d* suction-holding the wafer before processing in the take-in/take-out area 2*a* is positioned in the rough grinding area 2*b*. And, the chuck table 4*b* is positioned in the polishing area 2*d*, and the chuck table 4*c* is positioned in the take-in/take-out area 2*a*, respectively. In this state, the wafer roughly ground that is held on the chuck table 4*a* and positioned in the finish grinding area 2*c* is finish-ground with the finish grinding unit 80, and the wafer held on the chuck table 4*d* and positioned in the rough grinding area 2*b* is roughly ground with the rough grinding unit 8. During this, a wafer before processing is carried to the chuck table 4*c* positioned in the take-in/take-out area 2*a* and suction-held on the chuck table 4*c*.

Thereafter, the table turning means 6 is activated to further turn the above turntable 3 at 90° in the predetermined direction indicated by the arrow in FIG. 1 (therefore, the turntable 3 turns at 270° from the start position shown in FIG. 1). As a result, the chuck table 4*a* holding the wafer finish-ground in the finish grinding area 2*c* is positioned in the polishing area 2*d*, the chuck table 4*d* holding the wafer roughly ground in the rough grinding area 2*b* is positioned in the finish grinding area 2*c*, and the chuck table 4*c* suction-holding the wafer before processing in the take-in/take-out area 2*a* is positioned in the rough grinding area 2*b*. The chuck table 4*b* is positioned in the take-in/take-out area 2*a*. When the above turntable 3 turns, the air brush means mounted to the cover member 90 of the grinding chamber cover means 9 is activated to eject compressed air from the air brush nozzle 96. As a result, compressed air is ejected against the wafer that has been finish-ground and is held on the chuck table 4*a* moving from the finish grinding area 2*c* to the polishing area 2*d*, so that polishing chips and polishing water adhered to the wafer during grinding are removed. As described above, the turntable 3 is turned and hence, the wafer that has been roughly ground and is held on the chuck table 4*d* positioned in the finish grinding area 2*c* is finish-ground with the finish grinding unit 80, and the wafer held on the chuck table 4*c* positioned in the rough grinding area 2*b* is roughly ground with the rough grinding unit 8.

The wafer finish-ground and held on the chuck table 4*a* positioned in the polishing area 2*d* is subjected to a polish-processing suitable for the purpose of polishing the wafer, by the multipurpose polishing means 10. When the processing of the wafer is started by the processing machine in the illustrated embodiment, a suitable polishing method is determined in consideration of the material and type of the wafer. And, the optimum polishing tool is selected from the polishing tools 110, 114 and 116 shown in FIGS. 4(*a*) and 4(*b*), FIGS. 6(*a*) and 6(*b*) and FIG. 8, respectively, to carry out the suitable polishing method, and the selected polishing tool is set on the mounter 120. Therefore, polishing shown in FIG. 5, FIG. 7, FIG. 9 or FIG. 11 is made on the wafer finish-ground and held on the chuck table 4*a* positioned in the polishing area 2*d*, according to the polishing method determined by the multipurpose polishing means 10. When dry polishing is carried out with the polishing tool 110 shown in FIGS. 4(*a*) and 4(*b*), polishing powders which are scattered in the polishing chamber are absorbed into a dust collecting means (not shown) through the dust collecting duct 173 connected to the cover member 171 of the polishing chamber cover means 170. Meanwhile, a wafer before processing is carried to the chuck table 4*b* positioned in the take-in/take-out area 2*a* and suction-held on the chuck table 4*b*.

After the chuck table 4*a* holding the wafer before processing and first positioned in the take-in/take-out area 2*a* is then positioned in the rough grinding area 2*b*, finish grinding area 2*c* and polishing area 2*d* sequentially and processing in each area is all carried out, the above table turning means 6 is activated to turn the above turntable 3 in a direction opposite to the predetermined direction indicated by the arrow in FIG. 1 at 270° in the illustrated embodiment. As a result, the turntable 3 is returned to the start position and the chuck table 4*a* holding the wafer polished in the polishing area 2*d* is positioned in the take-in/take-out area 2*a* as described above. The chuck table 4*b* holding the wafer before processing in the take-in/take-out area 2*a* is positioned in the rough grinding area 2*b*, the chuck table 4*c* holding the wafer roughly ground in the rough grinding area 2*b* in the finish grinding area 2*c*, and the chuck table 4*d* holding the wafer finish-ground in the finish grinding area 3*c* in the polishing area 2*d*, respectively. When the above turntable 3 is turned, the above air brush means is activated to eject compressed air from the air brush nozzle 96 against the wafer that is finish-ground and held on the chuck table 4*d* moving from the finish grinding area 2*c* to the polishing area 2*d* so as to remove polishing chips and polishing water adhered to the wafer during grinding. As described above, the wafers held on the chuck tables positioned in the rough grinding area 2*b*, finish grinding area 2*c* and polishing area 2*d* respectively are roughly ground, finish ground and polished, respectively.

Meanwhile, the wafer held on the chuck table 4*a* returned to the take-in/take-out area 2*a* is subjected to cleaning of its processed surface. That is, the wash water ejection nozzles 401 of the above processed surface cleaning means 400 are positioned right above the wafer held on the chuck table 4*a* positioned in the take-in/take-out area 2*a* to spray wash water on the processed surface of the wafer held on the chuck table 4*a* from the wash water ejection nozzles 401, thereby removing polishing powders and the like adhered to the processed surface of the wafer. On this occasion, cleaning of the wafer is effected while moving the wash water ejection nozzles 401 along the guide rail 500.

After the processed surface of the wafer held on the chuck table 4*a* positioned in the take-in/take-out area 2*a* is cleaned, the suction-holding of the wafer on the chuck table 4*a* is canceled. The above wafer take-out means 270 is then operated to suction-hold the wafer on the chuck table 4*a* with the suction pad 271, take it out from the chuck table 4*a* and carry it to the above spinner cleaning means 241. The wafer after processing carried to the spinner cleaning means 241 is cleaned and dried with a spin drier. The thus cleaned and dried wafer after processed is carried to a predetermined position of the above second cassette 221 by the above wafer conveying means 250.

After the above wafer take-out means 270 takes out the wafer after processing on the chuck table positioned in the take-in/take-out area 2*a* and carries it to the spinner cleaning means 241, the suction pad 271 is positioned in the cleaning area of the suction pad cleaning means 290. The suction pad cleaning means 290 is activated to bring the cleaning sponge 291 into contact with the suction surface of the suction pad 271 and rotate the sponge 291 in a state of being immersed in the cleaning pool 292 to cleanest suction surface of the suction pad 271. After the suction surface of the suction pad 271 is cleaned, the wafer take-out means 270 positions the suction pad 271 at a stand-by position.

Meanwhile, the chuck table 4*a* which has been positioned in the take-in/take-out area 2*a* and from which the wafer after processing has been taken out is subjected to cleaning of its holding surface for placing the wafer. The cleaning of the holding surface of the chuck table 4*a* is carried out by the chuck table cleaning means 300. That is, the cleaning of the holding surface of the chuck table 4*a* is carried out by first rotating the chuck table 4*a* and activating the brush cleaning means 310 to bring the cleaning brush 311 into contact with the holding surface of the chuck table 4*a* so as to remove polishing powders and the like adhered to the holding surface of the chuck table 4*a*. Then, the grindstone cleaning means 320 is activated to bring the oil stone 321 into contact with the holding surface of the chuck table 4*a* to scrape off polishing powders which could not removed by the above cleaning brush 311 and are stuck to the holding surface to smooth the holding surface. After the holding surface of the chuck table 4*a* is thus cleaned, a wafer before processing is carried onto the holding surface of the chuck table 4*a* and suction-held on the chuck table 4*a*.

While the cleaning of the processed surface of the wafer held on the chuck table 4*a* returned to the take-in/take-out area 2*a*, the take-out of the wafer from the chuck table 4*a*, the cleaning of the holding surface of the chuck table 4*a* and the take-in of the wafer before processing to the chuck table 4*a* whose holding surface has been cleaned are carried out as described above, the above-described respective processing's are made on the wafers held on the respective chuck tables positioned in the rough grinding area 2*b*, finish grinding area 2*c* and polishing area 2*d*.

After a wafer before processing is again held on the chuck table 4*a* returned to the take-in/take-out area 2*a* as described above, the above table turning means 6 is activated to turn the above turntable 3 at 90° in the illustrated embodiment in the predetermined direction indicated by the arrow in FIG. 1, the chuck table 4*a* suction-holding the wafer before processing is positioned in the rough grinding area 2*b*, the chuck table 4*b* in the finish grinding area 2*c*, the chuck table 4*c* in the polishing area 2*d* and the chuck table 4*d* in the take-in/take-out area 2*a*. The above operation is repeated to carry out processing's on all the wafers before processing stored in the above first cassette 211.

In the above illustrated embodiment, after the above turntable 3 positioned at the standard position shown in FIG. 1 is turned at 90° each time in the predetermined direction indicated by the arrow, the chuck table 4*a* holding a wafer before processing and first positioned in the take-in/take-out area 2*a* is then positioned in the rough grinding area 2*b*, finish grinding area 2*c* and polishing area 2*d* sequentially and each processing is carried out the respective areas, the above table turning means 6 is activated to turn the turntable 3 in a direction opposite to the predetermined direction indicated by the arrow in FIG. 1 (270° in the illustrated embodiment) to return to the standard position. Therefore, the twisting of negative-pressure suction hoses connected to the chuck tables 4*a*, 4*b*, 4*c* and 4*d* mounted on the turntable 3 and harnesses connected to the servo motors 7 for rotary-driving the chuck tables can be prevented. That is, when the turntable 3 is designed to turn only in the predetermined direction, an expensive rotary joint must be installed on the turntable 3 at connections between the chuck tables and the servo motors to prevent twisting of the above hoses and harnesses. However, in the illustrated embodiment, since the above turntable 3 is turned at 270° from the standard position in the predetermined direction as described above and then, turned in the direction opposite to the predetermined direction to return to the standard position, it is possible to prevent the twisting of the hoses and harnesses without using an expensive rotary joint by setting the lengths of the above hoses and harnesses to allow the turntable 3 to turn at 270° in the illustrated embodiment.

In the above-described embodiment, one multipurpose polishing means 10 is arranged in the polishing area 2*d*. A plurality of multipurpose polishing means 10 may be provided to improve the production efficiency of the processing machine. That is, since polishing takes more time than grinding in general, the production efficiency of the processing machine is conformed to the processing efficiency of polishing which takes a lot of time. Therefore, a plurality of multipurpose polishing means 10 are installed to perform the polishing of one wafer by dividing it into several stages, thereby making it possible to improve the production efficiency of the processing machine.

In the above-described embodiment, the wafer is taken in and out in the take-in/take-out area 2*a*. The take-in area for taking in the wafer and the take-out area for taking out the wafer may be set separately. In this case, the cleaning of the processed surface of the wafer after processing and the cleaning of the holding surface of the chuck table may be carried out in the take-out area, or the cleaning of the processed surface of the wafer after processing may be carried out in the take-out area whereas the cleaning of the holding surface of the chuck table may be carried out in the take-in area.

A description is subsequently given of the number of chuck tables arranged on the above turntable and the turning angle in the predetermined direction of the turntable.

The number of chuck tables arranged on the turntable is a number obtained by adding the number of grinding means arranged in the above grinding areas, the number of the multipurpose polishing means arranged in the above polishing area and the number of the above take-in/take-out areas, and the chuck tables are arranged at an equal angle. When the number of the chuck tables is represented by N, the turntable is operated to turn at a range $(360° \times (N-1)/N)$ in the predetermined direction from the start position and then, turn in the direction opposite to the predetermined direction to return to the start position.

We claim:

1. A wafer processing machine comprising:

a turntable which is turnably arranged;

a plurality of chuck tables which are mounted on the turntable and have a holding surface for holding a wafer;

a grinding means for grinding a wafer held on the chuck table; and a multipurpose polishing means that is held on the chuck table and polishes the ground surface of a wafer ground by the grinding means wherein the multipurpose polishing means comprises a mounter for detachably mounting a polishing tool, a spindle unit for rotating the mounter, a spindle unit support means for supporting the spindle unit in such a manner that the spindle unit can move in a direction perpendicular to the holding surfaces of the chuck tables and in a direction parallel to the holding surfaces of the chuck tables, a first polishing-feed means for moving the spindle unit in a direction perpendicular to the holding surfaces of the chuck tables, and a second polishing-feed means for moving the spindle unit in a direction parallel to the holding surfaces of the chuck tables, and wherein a water case for receiving processing water supplied to a wafer, held on the chuck table, is arranged around the turntable, an annular sealing portion projects from the under surface of the outer peripheral portion of the turntable, and an annular sealing groove into which the lower end of the sealing portion is fitted is formed in the water case.

2. The wafer processing machine according to claim 1, wherein the water case is partitioned into the grinding areas and common areas consisting of the polishing area and the take-in/take-out area.

* * * * *